United States Patent [19]

Iwase et al.

[11] Patent Number: 4,637,132

[45] Date of Patent: Jan. 20, 1987

[54] APPARATUS FOR ASSEMBLING HEAT EXCHANGER CORE

[75] Inventors: Takatoshi Iwase, Anjo; Akira Nakagawa, Kariya, both of Japan

[73] Assignee: Nippondenso Co., Ltd., Kariya, Japan

[21] Appl. No.: 753,622

[22] Filed: Jul. 9, 1985

[30] Foreign Application Priority Data

Jul. 10, 1984 [JP] Japan ..... 59-141372

[51] Int. Cl.[4] ..... B23P 15/26

[52] U.S. Cl. ..... 29/726; 29/33 G; 29/157.3 R; 29/783; 29/822

[58] Field of Search ..... 29/33 G, 157.3 A, 157.3 B, 29/157.3 C, 157.3 R, 726, 727, 783, 809, 822

[56] References Cited

U.S. PATENT DOCUMENTS

| | | | |
|---|---|---|---|
| 3,102,330 | 9/1963 | Kritzer | 29/727 X |
| 3,114,963 | 12/1963 | Kritzer | 29/727 |
| 4,321,739 | 3/1982 | Martin et al. | 29/726 X |
| 4,486,933 | 12/1984 | Iwase et al. | 29/726 X |

*Primary Examiner*—Howard N. Goldberg
*Assistant Examiner*—R. S. Wallace
*Attorney, Agent, or Firm*—Cushman, Darby & Cushman

[57] ABSTRACT

An apparatus for automatically assembling a heat exchanger core assembly comprised of a pair of inserts and a plurality of tubes and corrugated fins arranged in an alternate manner. The assembled core elements are guided along a guide rail means while being fed by a pair of chain attachments. The core elements are then unloaded by elevatable guide rail means and removing means including compressible clamping jaws.

14 Claims, 18 Drawing Figures

APPARATUS FOR ASSEMBLING HEAT EXCHANGER CORE

BACKGROUND OF THE INVENTION

1. Field of the Invention

The present invention relates to an apparatus for the automatic assembling of a heat exchanger core assembly, for example, a radiator of an automobile; the core assembly being comprised of a pair of opposed inserts and a plurality of tubes and corrugated fins arranged in a alternate manner between the inserts.

2. Description of the Related Art

Conventionally, heat exchanger cores are assembled manually, using an assembly device in the form of a rectangular frame having one side open. A bottom insert is first placed in the frame and tubes and corrugated fins are then placed alternately, one by one, on the bottom insert and, finally, a top insert is placed on the uppermost corrugated fin. Thus a core assembly is completed in the frame. This assembly must then be compressed by hand and clamped by a hanger before removing it from the frame, which operation is inefficient and requires a certain degree of skill from the operators.

U.S. Pat. No. 4,321,739 to Martin et al. discloses a method for the automatic assembling of a heat exchanger core. This apparatus includes a pair of core assembly conveyors having chain-supported holders. The conveyors are guided by cammed guide rails in such a manner that they are moved toward each other (inward) to load the tubes and inserts and apart from each other (outward) to unload the tubes and inserts. Fins are loaded as a complete set on a grate holder at a separate station and delivered to the conveyors to be pushed down into the spaces between the tubes and inserts. The core assembly is then detached from the conveyors and guided by guide rails until transferred to a tip-up station. At the tip-up station, the core assembly is laid on a table pivotable to a vertical position and clamped to the table by clamps.

U.S. Pat. No. 4,486,933, issued on Dec. 11, 1984 and assigned to the same assignee as for the present application, discloses an apparatus for the automatic assembling of a heat exchanger core assembly comprising, a pair of chain attachments extended on either side of a guide rail and loading stations for inserts, tubes and fins, respectively, arranged in series above the chain attachments. The inserts, tubes and fins are pushed down on the guide rail one by one, and the ends of the tubes and inserts are inserted into top-opened gaps between adjacent chain elements of the chain attachments. Thus the chain attachments feed the inserts, tubes and fins along the guide rail. A very rapid and reliable operation can be attained with this apparatus, since the elements of the core assembly are loaded one by one and advance along a straight path. The chain attachments also move along a straight path, in contrast to the former prior art in which the conveyors are cammed.

SUMMARY OF THE INVENTION

It is an object of the present invention to improve an apparatus for assembling a heat exchanger core assembly, the apparatus comprising a guide rail, a pair of chain attachments extending on either side of the guide rail, and loading stations arranged above the chain attachment, by having the apparatus further comprise an unloading means for unloading the completed core assembly from the apparatus.

According to the present invention, there is provided an apparatus for assembling a heat exchanger core assembly comprised of a pair of opposed inserts and a plurality of tubes and corrugated fins arranged in an alternate manner between the inserts, the apparatus comprising: first guide rail means having a front end and a rear end; second guide rail means having a front end and a rear end, the second guide rail means being arranged in the such a manner that the rear end of the second guide rail means faces the front end of the first guide rail means so as to define a substantially continuous guide surface therealong; a pair of chain attachment means extending between the rear end of the first guide rail means and the front end of the second guide rail means on either side of the guide rail means and moving in a direction from the rear end of the first guide rail means to the front end of the second guide rail means; loading stations located between the rear end and the front end of the first guide rail means and above the chain attachment means for loading the inserts, tubes and corrugated fins, respectively, onto the first guide rail means, with the ends of the inserts and tubes engaged with the chain attachment means; means for elevating the second guide rail means between a first position in which the second guide rail means is in alignment with the first guide rail means and a second position elevated from the first position in which the inserts and the tubes are disengaged from the chain attachment means; and means for compressively clamping the core assembly on the second guide rail means when it is in the second position and for removing the core assembly from the second guide rail means.

The first guide rail means, the chain attachments means, and the loading stations can be arranged in a manner similar to that described in the above-referenced U.S. Pat. No. 4,486,933 but, according to the present invention, the chain attachment means are extended to the second guide rail means. The second guide rail means is elevated when receiving a complete core assembly, and thus the core assembly is disengaged form the chain attachment means. The core assembly is then compressed and removed from the second guide rail means to be delivered to a subsequent header assembling station. During this operational cycle, the chain attachment means runs continuously to constantly advance each subsequent core assembly.

Preferably, the apparatus further comprises a third upper guide rail means above the first guide rail means and a fourth guide rail means above the second guide rail means to prevent the fins from springing out. The fourth guide rail means is preferably rigidly connected to the second guide rail means.

Preferably, the means for compressively clamping and removing the core assembly comprises a rail extending in parallel to the chain attachment means and preferably arranged in such a manner that it is spaced from the chain attachment means in a side-by-side relationship, a support frame slidably supported on the rail, a pair of clamping jaws carried by the support frame, and means for causing the clamping jaws to move together and apart. The clamping jaws are preferably carried by the support frame in such a manner that they are tiltable between a first position in which the jaws are substantially upright and a second position in which the jaws extend transversely to the second guide rail means.

BRIEF DESCRIPTION OF THE DRAWINGS

Other objects and features of the present inven-tion will become apparent from the description of the preferred embodiment of the present invention in reference to the attached drawings, in which.

DESCRIPTION OF THE PREFERRED EMBODIMENT

Figure 1:
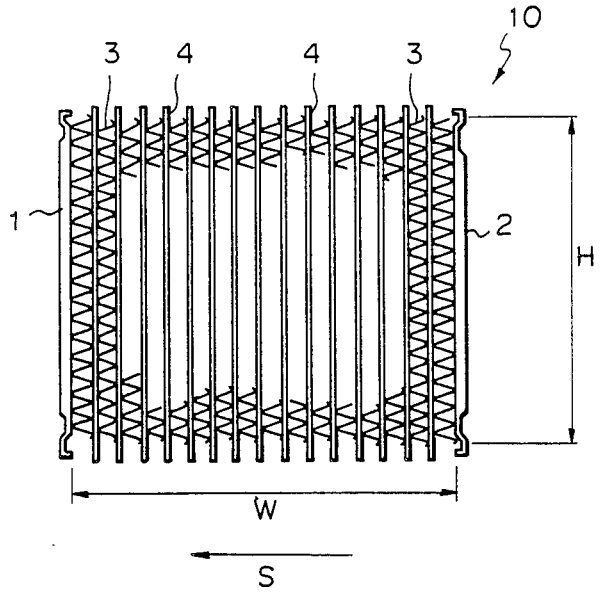
FIG. 1 is a plan view of a heat exchanger core assembly.

FIG. 1 shows a typical radiator core 10 for an automobile, which radiator core comprises a pair of inserts 1 and 2, and a plurality of tubes 4 and corrugated fins 3 arranged in an alternate manner between the inserts 1 and 2. The number of the fin 3 is greater by one than that of the tubes 4, so that the fins 3 are located at outermost positions relative to the tubes 4. As known in the art, the tubes 4 and inserts 1 and 2 have a length or a height, as measured in the sense of the arrow H, slightly greater than that of the fins 3, so that header plates (not shown) can be coupled to the ends of the tubes 4 and inserts 1 and 2 at the later stage of the assembling process. The width of the core assembly 10 is indicated by the arrow W. For simplicity, the insert 1 is hereinafter referred to as "the front insert" and the insert 2 is referred to as "the rear insert", since the core assembly 10 is transferred in the direction of the arrow S by the apparatus explained below.

Figure 2:
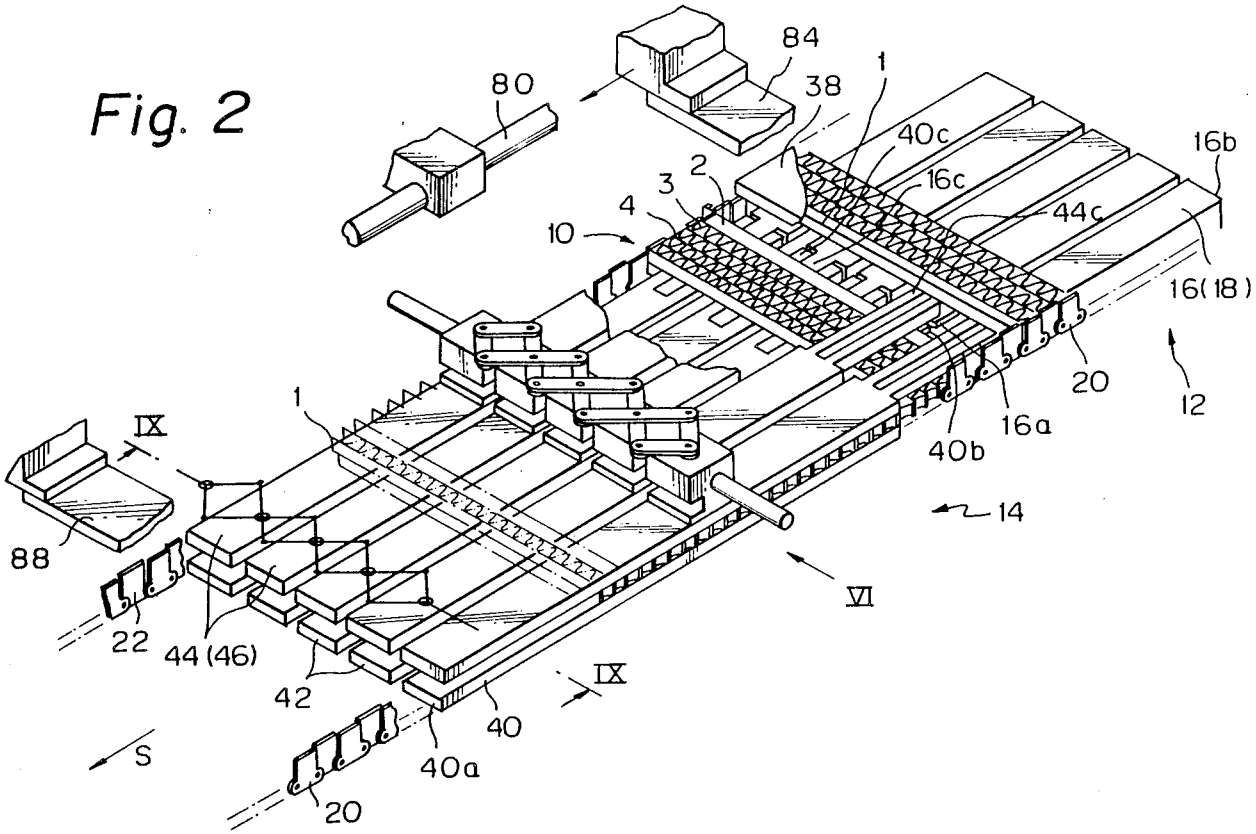
FIG. 2 is a schematic perspective view of an apparatus for assembling a heat exchanger core assembly, according to the present invention, with an elevation means omitted.
Figure 3:
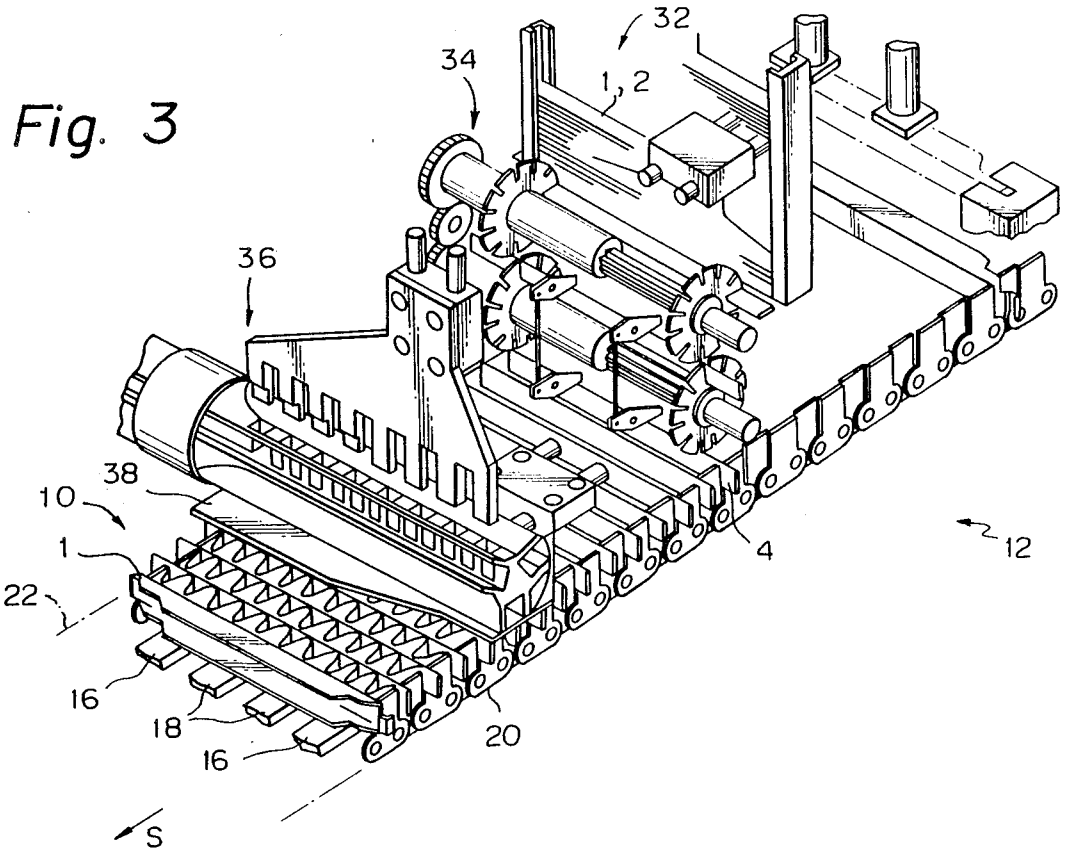
FIG. 3 is a schematic perspective view of an assembling station of FIG. 2.

FIG. 2 shows an apparatus for assembling the core assembly 10 or other heat exchanger core assemblies, according to the present invention, which generally comprises an assembling station 12 and unloading station 14. FIG. 3 illustrates the assembling station 12. As details of the assembling station 12 are described in the above-mentioned U.S. Pat. No. 4,486,933, only a brief description is made here to the extent necessary to understand the present invention. The assembling station comprises guide rail means 16 consisting of a plurality of horizontally coplanar guide plates 18 arranged parallel to each other. On either side of the guide rail means 16, a pair of endless chain attachments 20 and 22 (only 22 is shown in FIG. 3) extend parallel to the guide rail means 16.

Figure 4:
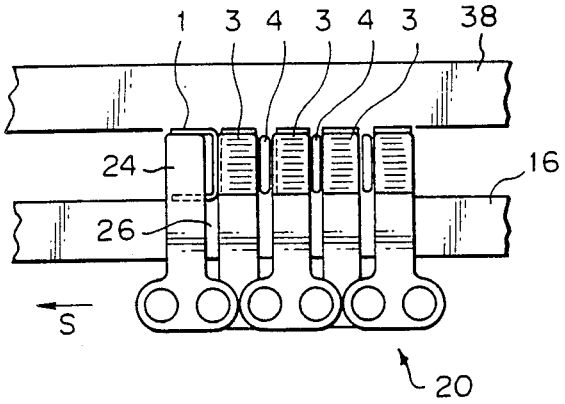
FIG. 4 is a side view of chain attachment.
Figure 5:
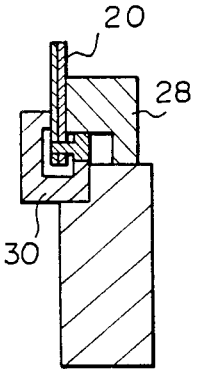
FIG. 5 is a sectional view of a support guide for the chain attachment.

Referring to FIG. 4, each chain attachment 20 or 22 has inverted substantially T-shaped chain elements 24 linked together at their base ends so as to provide gaps or slits 24 therebetween above the linked base ends. It will be seen that the gaps 24 are open at the top of the elements 24. Such gaps 24 are intended to receive the ends of the front and rear inserts 1 and 2 and tubes 4 from above, that is, the pair of the chain attachments 20 and 22 are adjusted so that the distance between the opposed chain attachments 20 and 22 is slightly less than the height H of the inserts 1 and 2 and tubes 4. The fins 3 can be inserted between the opposed chain attachments 20 and 22 and between the insert 1 or 2 and the tube 4 and between the adjacent tubes 4. The inserted inserts 1 and 2, tubes 4, and fins 3 are slidably rested on the horizontal guide rail means 16. Note, the endless chain attachments 20 and 22 have respective horizontal running portions which transfer each elements of the core assembly in one direction S. These horizontal running portions of the chain attachment means 20 and 22 are respectively guided by horizontal guides 28 and 30, as shown in FIG. 5.

Returning to FIG. 3, above the guide rail means 16 and the chain attachments 20 and 22 are arranged loading stations 32, 34, and 36. The station 32 at the upstream position loads or pushes down the front and rear inserts 1 and 2, one by one, at predetermined intervals on the guide rail means 16 and the chain attachments 20 and 22. The station 34 at the middle position loads the tubes 4, and the station 36 at the downstream position loads the fins 3. Between the downstream station 36 and the front end of the guide rail means 16, an upper guide rail means in the form of a flat plate 38 extends to prevent the fins 3 from springing out.

Returning to FIG. 2, the guide rail means 16 of the assembling station 12 has a front end 16*a* and a rear end 16*b*. The chain attachments 20 and 22 extend beyond the assembling station 12 toward the unloading station 14. The unloading station 14 comprises guide rail means 40 in correspondence with and in alignment to the guide rail means 16 of the assembling station 12. The guide rail means 40 comprises a plurality of guide plates 42 and has a front end 40*a* and a rear end 40*b*. The rear end 40*b* faces the front end 16*a* of the assembling station 12 so as to define a substantially continuous guide surface for assembled core assembly 10. The chain attachments 20 and 22 extend through the rear end 16*b* and the front end 40*a* as a horizontal running portion consisting of endless chains. The guide rail means 16 and 38 are stationary but can be adjusted in the transverse direction, as desired, in correspondence with the height H of the core assembly 10 and the distance between the chain attachments 20 and 22. Thus, the guide rail means 16 and 38 are referred to hereinafter as "stationary lower guide rail means" and "stationary upper guide rail means", respectively. Above the guide rail means 40, is arranged a guide rail means 44 likewise comprising a plurality of guide plates 46. The guide rail means 40 and 44 are referred to hereinafter as "movable lower guide rail means" and "movable upper guide rail means", respectively.

Figure 6:
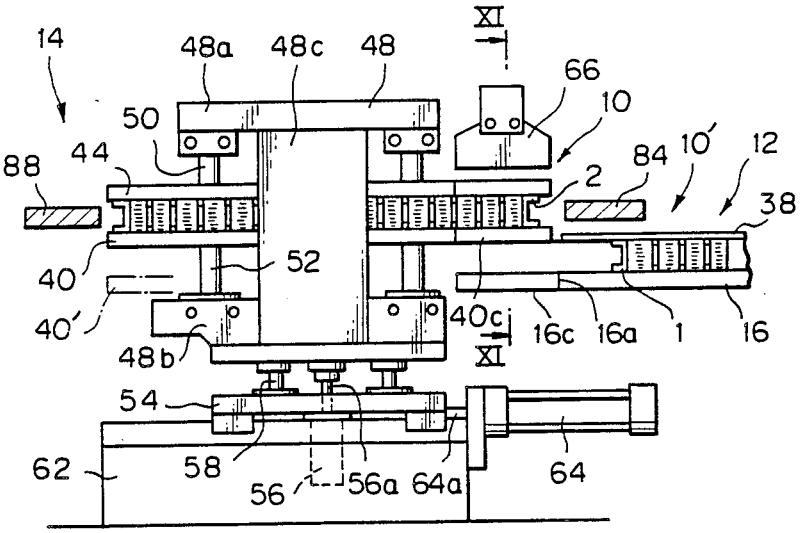
FIG. 6 is a side view of the apparatus, shown in the direction of the arrow VI in FIG. 2.

Referring to FIG. 6, the movable lower and upper guide rail means 40 and 44 are supported by a common support block 48 comprising an upper horizontal block 48*a*, a lower horizontal block 48*b*, and a vertical block 48*c*. The upper horizontal block 48*a* supports the movable upper guide rail means 44 via rail holders 50 and the lower horizontal block 48*b* supports the movable guide rail means 40 via rail holders 52. The support block 48 is carried by a support table 54 via a connecting rod 56*a* of a hydraulic cylinder 56 and a plurality of vertical rods 58 inserted in sleeves 60 (FIG. 9) in a known manner. The support table 54 is slidably carried on a base rail member 62 and connected to a connecting rod 64*a* of a hydraulic cylinder 64 so as to be moved in a direction parallel to the extending direction of the guide rail means 40. Thus the movable upper and lower guide rail means 44 and 40 are conjointly elevatable and movable in the direction described above. FIG. 6 shows the guide rail means 44 and 40 in the elevated position. The dash line 40' shows the lower guide rail means 40 in the lowered original position in which the movable lower guide rail means 40 is in alignment with the stationary lower guide rail means 16.

Figure 11:
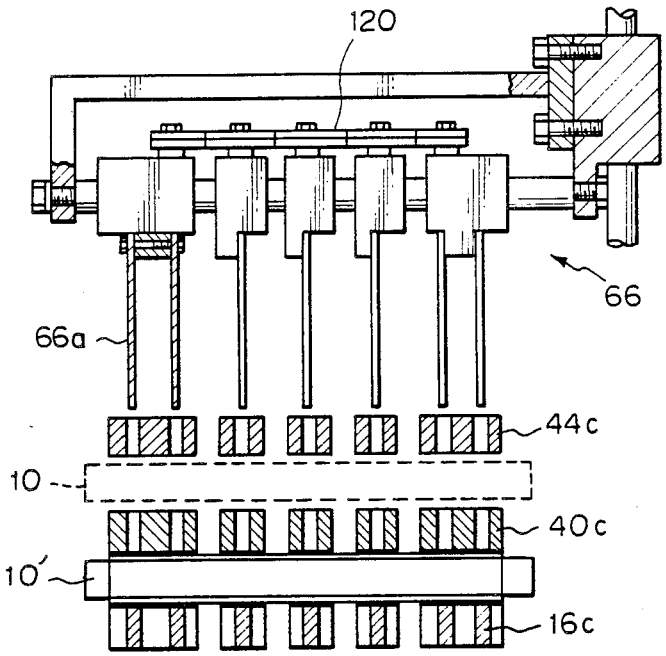
FIG. 11 is a section of a further guide taken along the lines XI—XI in FIG. 6.

As shown in FIGS. 2 and 6, the front end 16*a* of the stationary lower guide rail means 16 has longitudinal comb-teeth-like extensions 16*c* and the facing rear end 40*b* of the movable lower guide rail means 40 has complementary comb-teeth-like extensions 40*c*. The extensions 16*c* and 40*c* can be superposed on or mated with each other, and thus the extensions 16*c* of the stationary lower guide rail means 16 provide an additional guide surface in place of the movable lower guide rail means 40 when the means 40 is not in the lower original position 40'. The movable upper guide rail means 44 provides an upper guide surface coplanar with the stationary upper guide rail means 38. However, when elevated, the movable lower guide rail means 40 provides the upper guide surface coplanar with the stationary upper guide rail means 38, as shown in FIG. 6. Further, the rear end of the movable upper guide rail means 44 also has comb-teeth-like extensions 44*c* in correspondence with the extensions 40*c*, namely, the extensions 44*c* and 40*c* are vertically aligned. Arranged above the extensions 44*c* and 40*c* is a further guide 66 (FIG. 6). The detail of the further guide 66 is shown in FIG. 11. The further guide 66 has a plurality of vertical guide members 66*a* which, when lowered, can penetrate into slits between the extensions 44*c* and 40*c* to define an upper guide surface such as those provided by the movable upper guide rail means 44 in the lowered original position and by the movable lower guide rail means 40 in the elevated position. The core assembly 10 is clamped and moved away before the further guide 66 is lowered, as will be explained later.

It is to be understood that the chain attachments 20 and 22 run continuously and each of the elements of the core assembly 10 is loaded onto the stationary lower guide rail means 16 and the chain attachments 20 and 22 in such a manner that an interval is left between the loading core assembly 10 and the following core assembly 10', namely, between the rear inserts of the leading core assembly 10 and the front insert 1 of the following assembly 10', as shown in FIG. 6. When the core assembly 10 on the movable lower guide rail means 40 is complete, the movable lower guide rail means 40 is elevated. In this elevated position, the elements of the core assembly 10 are disengaged from the chain attachments 20 and 22. Thus the core assembly 10 remains on the movable lower guide rail means 40, while the next core assembly 10' continues to be transferred by the running chain attachments 20 and 22 to advance onto the extensions 16*c* of the stationary lower guide rail means 16. The elevated movable lower guide rail means 40 then provides the upper guide surface, which is also provided, in turn, by the further guide 66.

Figure 7:
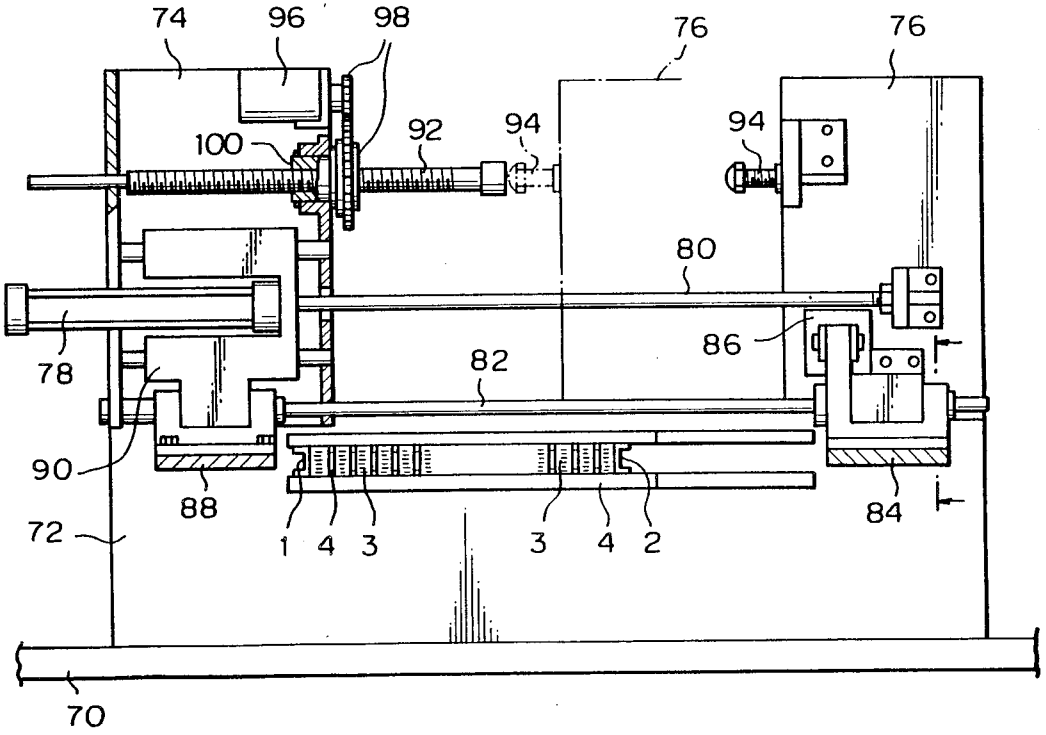
FIG. 7 is a side view of clamping and drawing means of the apparatus in FIG. 2.
Figure 8:
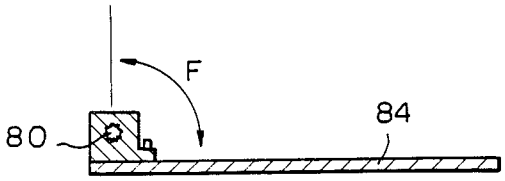
FIG. 8 is a section of a clamping jaw, taken along the lines IIX—IIX in FIG. 7.

Referring to FIGS. 2 and 7, a means is provided for compressively clamping the core assembly 10 when on the movable lower guide rail means 40 and removing the core assembly 10 from the guide rail means 40. This means comprises, as shown in FIG. 7, a guide rail 70 extending in parallel to the chain attachments 20 and 22 and spaced therefrom in a side-by-side relationship. A support frame 72 carrying a pair of slider blocks 74 and 76 is slidably supported on the guide rail 70. A hydraulic cylinder 78 is mounted on the slider block 74, and a connecting rod 80 of the cylinder 78 is connected to the other slider block 76. A spline shaft 82 extends between the slider blocks 74 and 76. A clamping jaw 84 is mounted on the slider block 76 and slidably coupled with the spline shaft 82 at one end thereof. The clamping jaw 84 is connected to the slider block 76 by a hydraulic cylinder 86 in such a manner that the clamping jaw 84 can tilt between a first substantially upright position and a second horizontal position in which it extends transversely to the movable guide rail means 40 and 44, as shown in FIG. 8. Another clamping jaw 88 is similarly mounted on the slider block 74 and slidably coupled with the spline shaft 82 at the other end thereof, thus enabling the clamping jaw 88 to be tilted simultaneously with the clamping jaw 84. The clamping jaw 88 is further engaged by a further slider block 90 interconnectably mounted on the slider block 74 and slidable by a hydraulic cylinder (not shown) to cause the clamping jaw 88 to move relative to the slider block 74. The other clamping jaw 84 is non-slidably but tiltably fixed to the slider block 76. A screw shaft stopper 92 is mounted on the slider block 74, the stopper 92 associating with a stopper 94 mounted on the slider block 76 to determine the distance between the clamping jaws 84 and 88, and thus determining the dimension W of the core assembly 10 when compressed by the actuation of the hydraulic cylinder 78.

Note, that the clamping jaws 84 and 88 do not interfere with the chain attachments 20 and 22 and the movable guide rail means 40 and 44 when the jaws 84 and 88 are in the first upright position, and that the jaws 84 and 88 are at the same level as the core assembly 10 when elevated, as can be seen in FIG. 6, when the jaws 84 and 88 are in the second horizontal position. The distance between the jaws 84 and 88 in their retracted position is slightly greater than the length of the guide rail means 40 and 44, and, in the retracted position, the jaws 84 and 88 are located outside of the guide rail means 40 and 44. The clamping jaw 84 is then caused to move toward the other jaw 88 to compressively clamp the core assembly 10 between the lower and upper guide rail means 40 and 44 by the actuation of the hydraulic cylinder 78, until the stopper 94 engages with the screw shaft stopper 92. The screw shaft stopper 92 is adjustable by an electric step motor 96 through gears 98 and a nut 100 in accordance with any desired dimension W of the core assembly. At this point, a hydraulic cylinder (not shown) is activated to cause the support frame 72 to move along the guide rail 70 in the direction S, to remove the compressed core assembly 10 from the lower and the upper guide rail means 40 and 44. The core assembly 10 is then transferred to a header machine (not shown). When the core assembly 10 is clamped by the header machine, the clamping jaw 88 is moved to the left, as viewed in FIG. 7, by the slider block 90 by the actuation of a hydraulic cylinder (not shown), and the other clamping jaw 84 is moved to the right by the actuation of the hydraulic cylinder 78.

Figure 10:
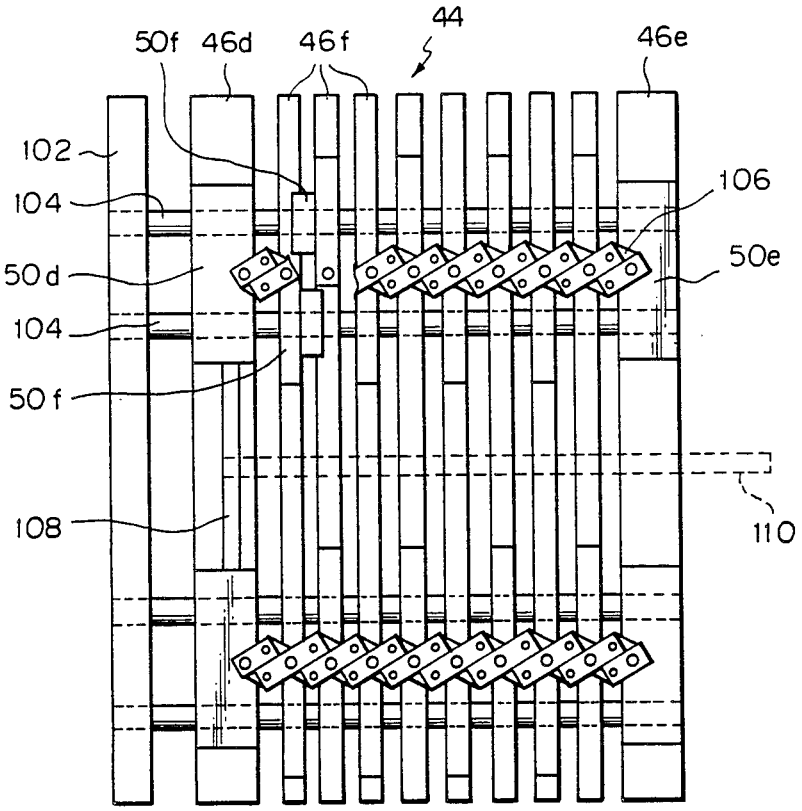
FIG. 10 is a plan view of of guide plates and the pantagraph linkage thereof.
Figure 9:
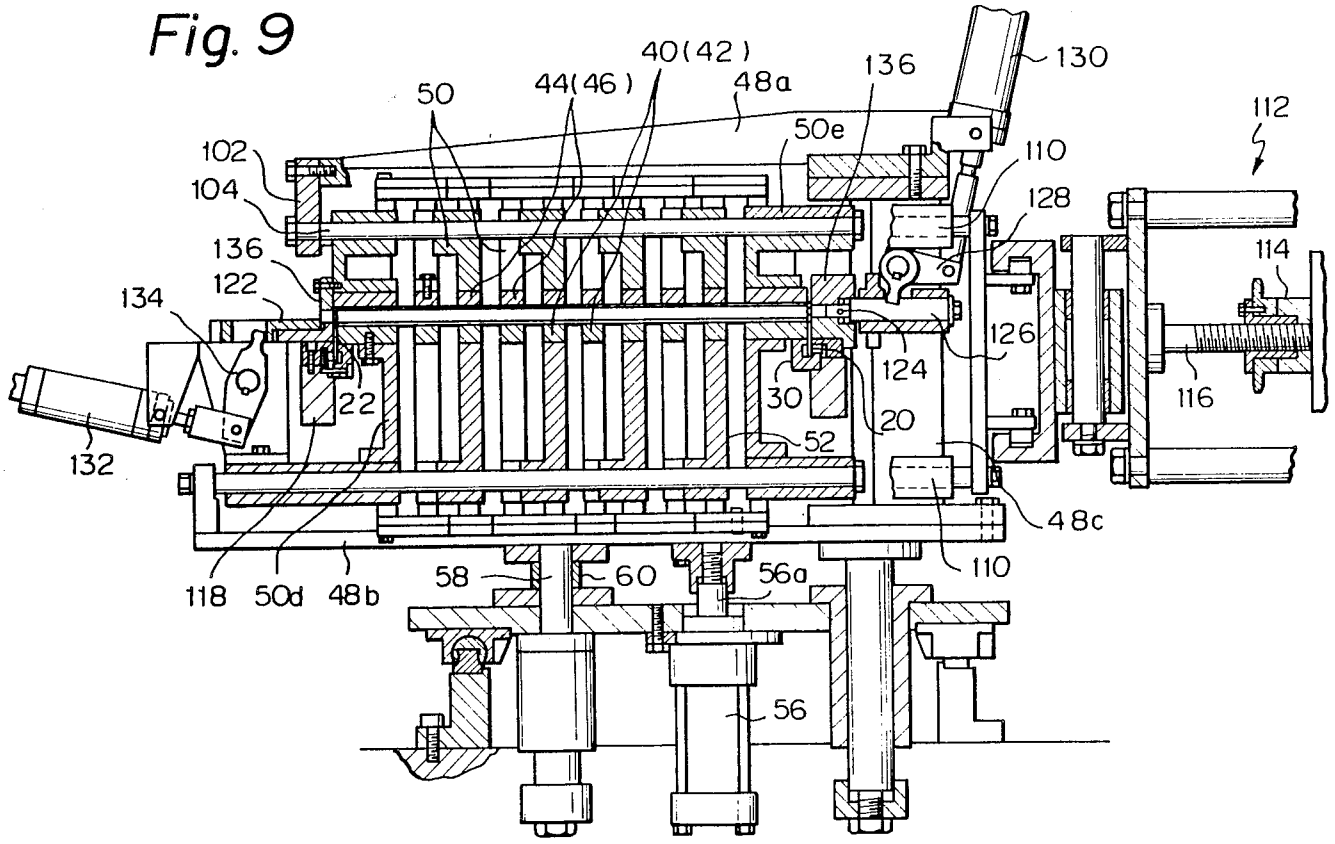
FIG. 9 is a section of the apparatus, taken along the lines IX—IX in FIG. 2.

FIG. 9 shows further details of the movable lower and the upper guide rail means 40 and 44 and their cooperating components. The practical design of the movable lower and upper guide rail means 40 and 44 can include a larger number of guide plates 42 and 46 than shown in FIG. 2. A practical arrangement of the upper guide rail means 44 is also shown in FIG. 10. In FIG. 10, the guide rail means 44 includes two outermost guide plates 46*d* and 46*e* and intermediate guide plates 46*f*. The outermost guide plate 46*e* is rigidly secured to the upper support block 48*a* through a rail holder 50*e* and a support plate 102 suspended from the support block 48*a* outside of the other guide plate 46*d*. Two sets of pairs of support shaft 104 extend between the support plate 102 and the fixed rail holder 50*e*. The rail holder 50*d* is slidably supported by the pair of support shafts 104. The remaining intermediate rail holders 50*f* are alternatively supported by the support shafts 104. A pantagraph linkage 106 is engaged with the rail holders 50*d*, 50*f* and 50*e*. The outermost rail holder 50*d* is linked to an actuation device 112 through a linkage 108 and a connecting rod 110. A part of the actuation device 112 is shown in FIG. 9, which comprises a nut 114 driven by an electric motor (not shown) and a screw shaft 116 which is operably connected to the connecting rod 110. The rail holders 50*d* and 50*f* together with associated guide plates 46*d* and 46*f* can be moved together through pantagraph linkage 106 so that the distance therebetween can be varied in accordance with the dimension H of any desired core assembly 10. The horizontal guide rail 118 (FIG. 9) supporting the guides 28 and 30 (FIG. 5) for one of the chain attachments 20 and 22 can be connected to the outermost (lower) rail holder 50*d*, thus the distance between the chain attachments 20 and 22 can be simultaneously adjusted with the guide rail means 40 and 46. Further, the further guides 66 are also linked by a similar pantagraph linkage 120, as shown in FIG. 11.

FIG. 9 shows a pair of tube guides 122 and 124 which extend longitudinally with respect to the guide rail means 40 and 44 and engage with the ends of the tubes 4. One of the tube guides 124, i.e., on the right in FIG. 9, is connected at separate positions to two pins 126 (only one shown in FIG. 9), which are in turn connected to one end of a bell-crank 128, the other end of which is connected to a hydraulic cylinder 130. The other tube guide 122 is connected to a hydraulic cylinder 132 through a linkage 134. A spring can be arranged between the tube guide 122 and the linkage 134 to provide a resilient force for the tubes 4. Namely, the tube guide 122 can retract to prevent the tubes 4 from deformation when the compression force is applied to the core assembly 10, since the tubes 4 are apt to be displaced traversely of the guide rail means 40 and 44. A resilient force can be also provided by setting the urging pressure of one of the hydraulic cylinders 130 and 132 to a relatively low value. The tube guide 124 and corresponding cylinder 130 are carried by the support block 48, and the other tube guide 122 and corresponding cylinder 132 are carried by the adjustable rail holder 50*d*. These cylinders 130 and 132 can be activated just after the complete core assembly 10 reaches the movable lower guide rail means 40.

The Figure also shows fin guides 136, which are located above and below the tube guides 122 and 124, respectively and slightly inward of the tube guides 122 and 124. The fin guides 136 can be carried by the outermost rail guides 50*d* and 50*e*, respectively.

The operation of the apparatus for assembling the heat exchanger core 10 is summarized below, referring to FIGS. 12*a* to 12*g*.

Figure 12A:
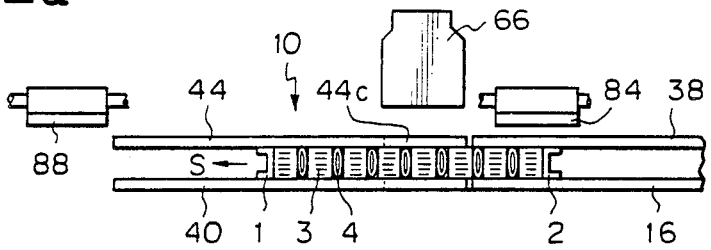
FIGS. 12*a* to 12*g* illustrate the sequential operation of the apparatus according to the present invention.

FIG. 12*a* shows the unloading station 14 in the initial condition. The core assembly 10 is advanced toward the movable guide rail means 40 and 44. The pair of clamping jaws 84 and 88 are waiting above and at opposite ends of the movable guide rail means 40 and 44. The further guide 66 is raised above the extensions 44*c* of the movable upper guide rail means 44.

Figure 12B:
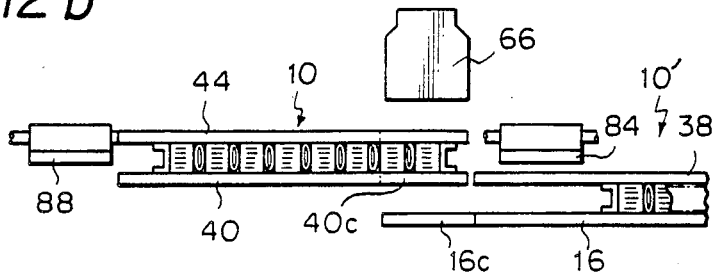
Figure 12C:
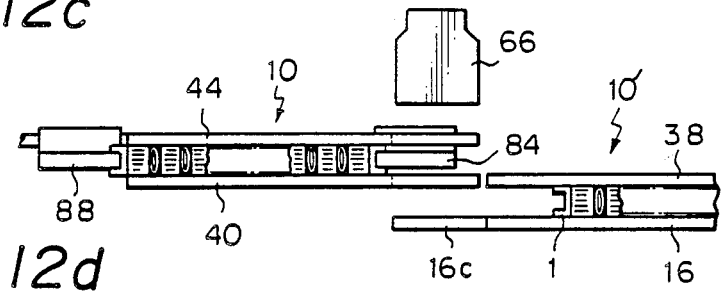
Figure 12D:
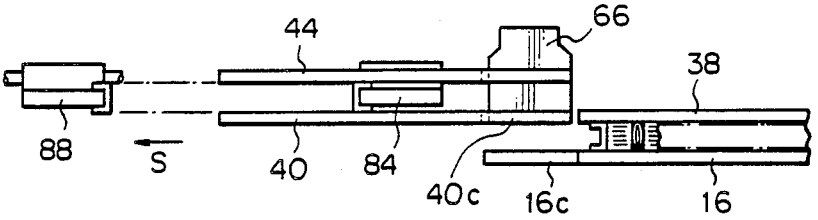

When the complete core assembly 10 reaches the movable lower and upper guide rail means 40 and 42, the rail means 40 and 42 and the core assembly 10 are elevated (FIG. 12*b*). At this point, the core assembly 10 is disengaged from the chain attachments 20 and 22, which continue to advance the next core assembly 10'. Then the clamping jaw 184 is moved to compressively clamp the core assembly 10 (FIG. 12*c*). The clamping jaws 84 and 88 are caused to move in the same direction as that of the chain attachments 20 and 22 to remove the compressed core assembly 10, and the further guide 66 is lowered to penetrate into the extensions 40*c* and 44*c* of the movable guide rail means 40 and 42 until reaching the level at which the further guide 66 provides the additional upper guide surfaces (FIG. 12*d*).

Figure 12E:
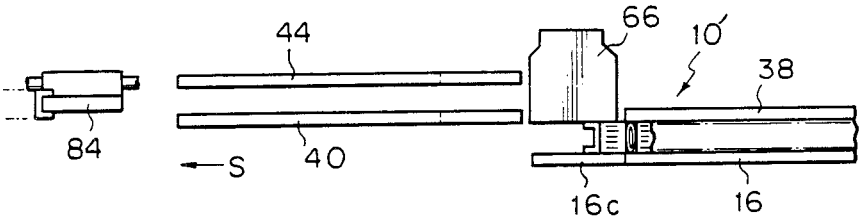
Figure 12F:
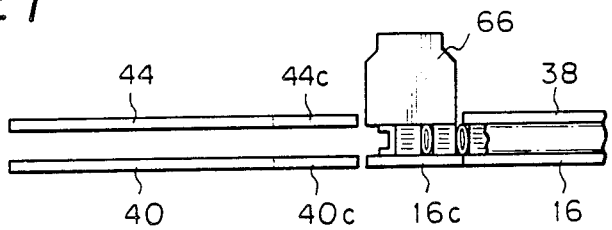
Figure 12G:
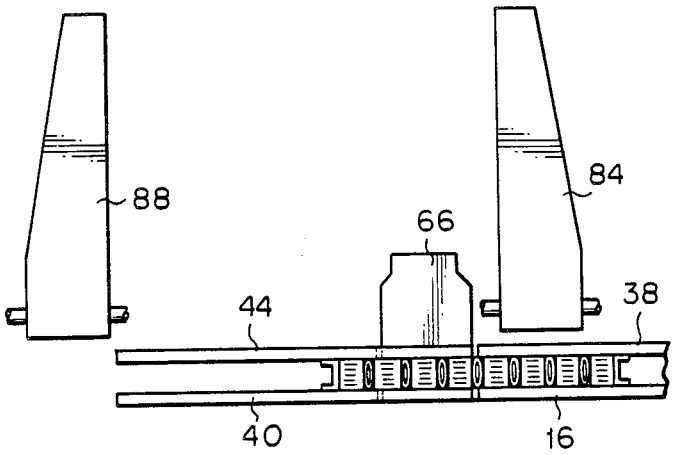

Then the clamping jaws 84 and 88 move further along and transfer the core assembly 10 to the header machine (not shown), and the next core assembly 10' reaches the extensions 16*c* of the stationary guide rail means 16, the upper guide being provided by the further guide 66 (FIG. 12*e*). At this point, the movable guide rail means 40 and 42 must move in the direction S, since the elements of the core assembly 10 extend trasversely on the extensions 16*c* and thus the movable guide rail means 40 and 44 cannot be lowered directly to the initial position. The movable guide rail means 40 and 44 are lowered vertically to the original level but slightly displaced horizontally from the initial position (FIG. 12*f*). The movable guide rail means 44 and 46 are then returned to the initial position (FIG. 12*g*). The clamping jaws 84 and 88, after the transfer of the core assembly 10 to the header machine, are tilted into the upright position and returned to the waiting position. The further guide 66 is raised after the movable guide rail means 40 and 44 return to the initial position.

Note that, according to the present invention, the operation including assembling and unloading the core assembly can be completed fully automatically, and that this automatic operation is both rapid and reliable. The unloading cycle does not require intermittent stoppages of the assembling line which can operate as if the unloading station is not provided.

We claim:

1. An apparatus for assembling a heat exchanger core assembly comprised of a pair of opposed inserts and a plurality of tubes and corrugated fins arranged in an alternate manner between the inserts, said apparatus comprising:

first guide rail means having a front end and a rear end;

second guide rail means having a front end and a rear end, the second guide rail means being arranged in such a manner that the rear end of the second guide rail means faces the front end of the first guide rail means so as to define a substantially continuous guide surface therealong;

a pair of chain attachment means extending between the rear end of the first guide rail means and the front end of the second guide rail means on either side of the guide rail means for movement in a direction from the rear end of the first guide rail means to the front end of the second guide rail means;

loading stations located between the rear end and the front end of the first guide rail means above the chain attachment means for loading the inserts, tubes and corrugated fins, respectively, on the first guide rail means, with the ends of the inserts and tubes engaged with the chain attachment means;

means for elevating the second guide rail means between a first position in which the second guide rail means is in alignment with the first guide rail means and a second position elevated from the first position in which the inserts and the tubes are disengaged from the chain attachment means; and means for compressively clamping the core assembly on the second guide rail means when said second guide rail means is in the second position and for removing the core assembly from the second guide rail means.

2. An apparatus according to claim 1, further comprising a third upper guide rail means above the first guide rail means adjacent to the front end of the first guide rail means, a fourth upper guide rail means above the second guide rail means, and means for connecting the fourth guide rail means to the second guide rail means for conjoint movement therebetween.

3. An apparatus according to claim 2, wherein each of the first, second, third, and fourth guide rail means extends horizontally.

4. An apparatus according to claim 3, wherein the second guide rail means is in alignment with the third guide rail means when the second guide rail means is in the second elevated position.

5. An apparatus according to claim 4, wherein each of the first, second and fourth guide rail means comprises a plurality of coplaner guide plates extending parallel to each other, and the third guide rail means comprises a flat guide plate.

6. An apparatus according to claim 5, wherein the distance between the adjacent guide plates is adjustable in correspondence with the size of a core assembly to the assembled.

7. An apparatus according to claim 6, wherein the distance between the pair of the chain attachment means is adjustable in correspondence with the size of a core assembly to be assembled.

8. An apparatus according to claim 3, wherein the front end of the first guide rail means has a comb-teeth-like extension or extensions extending therefrom and the rear end of the second guide rail means has a complementary comb-teeth-like extension or extensions extending therefrom so that these extensions can be superposed when the second guide rail means is in the first position and the extension or extensions of the first guide rail means provide an additional guide surface when the second guide rail means is in the first position.

9. An apparatus according to claim 8, wherein the rear end of the fourth guide rail means has a comb-teeth-like extension or extensions extending therefrom in correspondence with the extension or extensions of the second guide rail means, and wherein a further guide having a comb-teeth extension or extensions is provided above the fourth guide rail means, said further guide being vertically movable to interpenetrate the extensions of the fourth and second guide rail means to define an additional upper guide surface over the extension or extensions of the first guide rail means when the second guide rail means is in the second position.

10. An apparatus according to claim 2, further comprising means for causing the second guide rail means to move in a direction parallel to the extending direction of the chain attachment means.

11. An apparatus according to claim 3, wherein said means for compressively clamping and removing the core assembly comprises a rail extending parallel to the chain attachment means, a support frame slidably supported on the rail, a pair of spaced clamping jaws carried by the support frame and means for causing the jaws to move close to and apart from each other.

12. An apparatus according to claim 11, wherein the rail is spaced from the chain attachment means in a side-by-side relationship, and the jaws are carried by the support frame in such a manner that said jaws are tiltable between a first position in which the jaws are substantially upright and a second position in which the jaws extend transversely of the second guide rail means.

13. An apparatus according to claim 3, wherein a pair of tube guides for guiding tubes extend longitudinally of the second guide rail means to engage with the ends of the tubes, one of the tube guides being resiliently movable to prevent in the tubes from deforming upon compression of the core assembly.

14. An apparatus according to claim 13, wherein a pair of fin guides for guiding the ends of the corrugated fins extend longitudinally of the second guide rail means to engage with the ends of the corrugated fins, the fin guides extending above and below the tube guides, respectively, and transversely inward of the tube guides.

* * * * *